US010597194B2

(12) United States Patent
Little et al.

(10) Patent No.: US 10,597,194 B2
(45) Date of Patent: Mar. 24, 2020

(54) SEED CONTAINER AND SHELL RECEPTACLE

(71) Applicants: Paden Little, Edmond, OK (US); Jennifer Little, Edmond, OK (US)

(72) Inventors: Paden Little, Edmond, OK (US); Jennifer Little, Edmond, OK (US)

( * ) Notice: Subject to any disclaimer, the term of this patent is extended or adjusted under 35 U.S.C. 154(b) by 239 days.

(21) Appl. No.: 15/584,821

(22) Filed: May 2, 2017

(65) Prior Publication Data

US 2017/0313463 A1 Nov. 2, 2017

Related U.S. Application Data

(60) Provisional application No. 62/330,364, filed on May 2, 2016.

(51) Int. Cl.

| | |
|---|---|
| ***B65D 25/04*** | (2006.01) |
| ***B65D 47/08*** | (2006.01) |
| ***B65D 8/00*** | (2006.01) |
| ***B65D 77/04*** | (2006.01) |
| ***A47G 19/32*** | (2006.01) |

(52) U.S. Cl.

CPC ..... *B65D 25/04* (2013.01); *B65D 11/04* (2013.01); *B65D 47/0876* (2013.01); *B65D 47/0885* (2013.01); *B65D 77/0493* (2013.01); *A47G 19/32* (2013.01); *B65D 2209/00* (2013.01)

(58) Field of Classification Search

USPC ..... 220/526, 506; 221/97, 102

See application file for complete search history.

(56) References Cited

U.S. PATENT DOCUMENTS

| | | | | |
|---|---|---|---|---|
| 1,333,695 | A * | 3/1920 | Anshelm | A24F 15/18 206/38 |
| 3,729,114 | A * | 4/1973 | Mari | A47G 7/06 220/504 |
| 4,584,848 | A * | 4/1986 | Barnett | F25D 3/107 220/506 |
| 5,487,486 | A | 1/1996 | Meneo | |
| 6,179,153 | B1 | 1/2001 | Huang | |
| 6,398,071 | B1 | 6/2002 | Fellers | |
| 7,882,991 | B2 | 2/2011 | Schechter | |
| 8,074,841 | B1 | 12/2011 | Craig et al. | |
| 8,777,044 | B1 * | 7/2014 | Raymus | A47G 19/2272 215/12.1 |
| 8,955,707 | B2 * | 2/2015 | Lim | B65D 81/3216 220/592.03 |
| 2005/0161424 | A1 | 7/2005 | Hogan | |

* cited by examiner

*Primary Examiner* — Jeffrey R Allen

(74) *Attorney, Agent, or Firm* — Boudwin Intellectual Property

(57) ABSTRACT

A seed container and shell receptacle for separately storing fresh and used seeds. The seed container and shell receptacle includes an outer container having at least one sidewall, an open upper end, and a removably securable base defining an interior outer volume. An inner container having at least one sidewall, an open top end, and an open bottom end nests within the outer container such that the base of the outer container acts as the inner container's base defining an interior inner volume. A lid is removably securable to the open upper end of the outer container and includes a first and second aperture giving access to the interior outer volume and interior inner volume, respectively. The first and second apertures can be sealed by a first and second sealing mechanism respectively.

10 Claims, 5 Drawing Sheets

SEED CONTAINER AND SHELL RECEPTACLE

CROSS REFERENCE TO RELATED APPLICATIONS

This application claims the benefit of U.S. Provisional Application No. 62/330,364 filed on May 2, 2016. The above identified patent application is herein incorporated by reference in its entirety to provide continuity of disclosure.

BACKGROUND OF THE INVENTION

The present invention relates to nesting containers. More specifically, the present invention provides a seed container and shell receptacle adapted to separately store fresh and used seeds.

Many individuals like to eat seeds such as sunflower seeds. However, sunflower seeds are sold with the inedible outer shell still attached. Therefore, when a consumer wishes to consume a sunflower seed, it must first be removed from the shell, which then must be discarded. Unfortunately, one does not always have a designated location for discarding those shells. It is not always possible or acceptable to discard the shell on the ground, and the alternative requires either commingling eaten and uneaten seeds in the same container, or carrying a second container in which to discard the shells.

In light of the devices disclosed in the known art, it is submitted that the present invention substantially diverges in design elements from the known art and consequently it is clear that there is a need in the art for an improvement to existing seed containers and shell receptacles. In this regard the instant invention substantially fulfills these needs.

SUMMARY OF THE INVENTION

In view of the foregoing disadvantages inherent in the known types of seed container and shell receptacles now present in the known art, the present invention provides a seed container and shell receptacle wherein the same can be utilized for providing convenience for the user when consuming seeds or other items that produce inedible byproducts such as shells.

The present system comprises an outer container comprising an outer sidewall, a base, and an open upper end, defining an interior outer volume, wherein the base is removably securable. An inner container comprising an inner sidewall, an open bottom end, and an open top end is configured to nest within the outer container such that the base of the outer container acts as a base to the inner container and defines an interior inner volume. A lid having a first aperture disposed to give access to the interior outer volume and a second aperture disposed to give access to the interior inner volume is removably securable to the open end of the outer container. The first aperture and second aperture are adapted to be closed by a first door and a second door, respectively.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
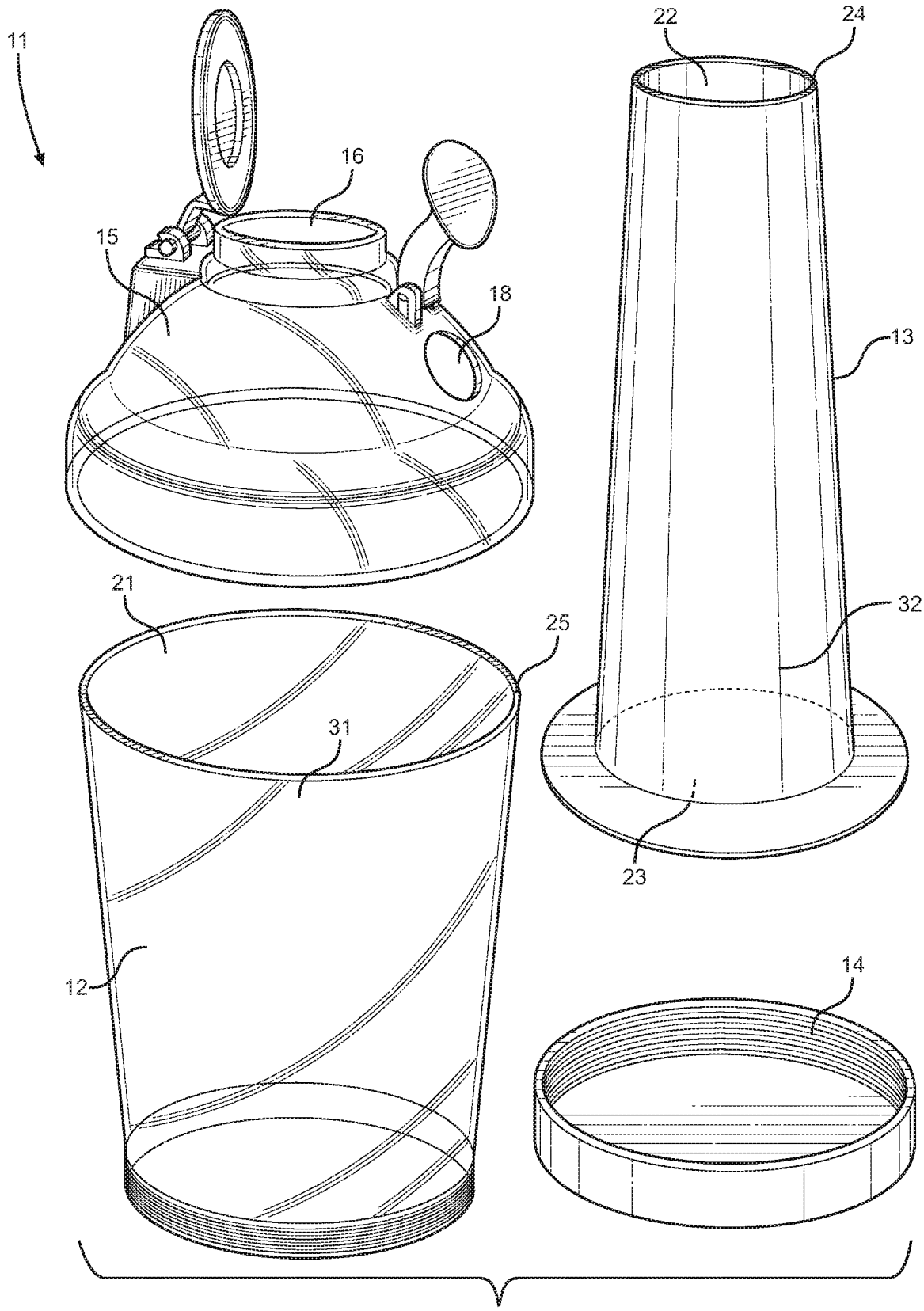
FIG. 1 shows a perspective view of an embodiment of the seed container and shell receptacle.

Reference is made herein to the attached drawings. Like reference numerals are used throughout the drawings to depict like or similar elements of the seed container and shell receptacle. The figures are intended for representative purposes only and should not be considered to be limiting in any respect.

Referring now to FIG. 1, there is shown a perspective view of an embodiment of the seed container and shell receptacle. The seed container and shell receptacle 11 comprises an outer container 12 having an outer sidewall 25, a base 14, and an open upper end 21, defining an interior outer volume 31. In the illustrated embodiment, the outer sidewall 25 tapers outwardly towards the open upper end 21 such that the diameter of the open upper end 21 is greater than the diameter of the base 14. This creates an outer container 12 with an inverted truncated conical configuration. The base 14 is removably securable to the outer container 12. In the illustrated embodiment, the base 14 is internally threaded to engage external threads on the outer container 12. In another embodiment, the base 14 is configured to removably secure to the outer container 12 via a compression fit similar to plug. In some embodiments, the base 14 further comprises a concentric cylindrical protrusion extending upwards from the upper surface of the base. The concentric cylindrical protrusion is configured to secure within an open bottom end 23 of an inner container 13.

An inner container 13 comprising an inner sidewall 24, an open bottom end 23, and an open top end 22 is configured to nest within the outer container 12. This nesting configuration allows the inner container 13 to share the base 14 with the outer container 12, defining an interior inner volume 32. In the illustrated embodiment, the inner container 13 is configured in a truncated conical shape wherein the inner sidewall 24 tapers outwardly towards the open bottom end 23, such that the diameter of the open top end 22 is less than the diameter of the open bottom end 23. In the illustrated embodiment, the inner container 13 and the outer container 12 are concentric wherein the distance between the inner sidewall 24 and the outer sidewall 25 is radially equal therearound.

A lid 15 is configured to be removably securable to the open upper end 21 of the outer container 12. In the illustrated embodiment, the lid 15 is dome-shaped, however in other embodiments, other configurations such as planar or conical lids would function similarly. In some embodiments, the lid 15 is internally threaded to engage external threads disposed along the open upper end 21 of the outer container 12. The lid 15 comprises a first aperture 18 disposed to give access to the interior outer volume 31 of the outer container 12, and a second aperture 16 disposed to give access to the interior inner volume 32 of the inner container 13. The first and second aperture 18, 16 are adapted to be sealed such that the contents of the interior inner volume 32 and the contents of the interior outer volume 31 remain inside the inner container 13 and the outer container 12, respectively. In the illustrated embodiment, the first aperture 18 and the second aperture 16 are both round, however, any shape would provide the same function.

In one use, the seed container and shell receptacle 11 is assembled, wherein the unshelled seeds are stored in the interior outer volume 31 and selectively discharged from the first aperture 18 via movement and manipulation thereof. Once deshelled and seed consumed, the shell is receivable in the interior inner volume 32 via the second aperture 16. Upon removal of the base 14, the contents of the interior inner volume 32 can be discharged, while the contents of the interior outer volume 31 can be discharged upon removal of the lid 15.

Figure 2:
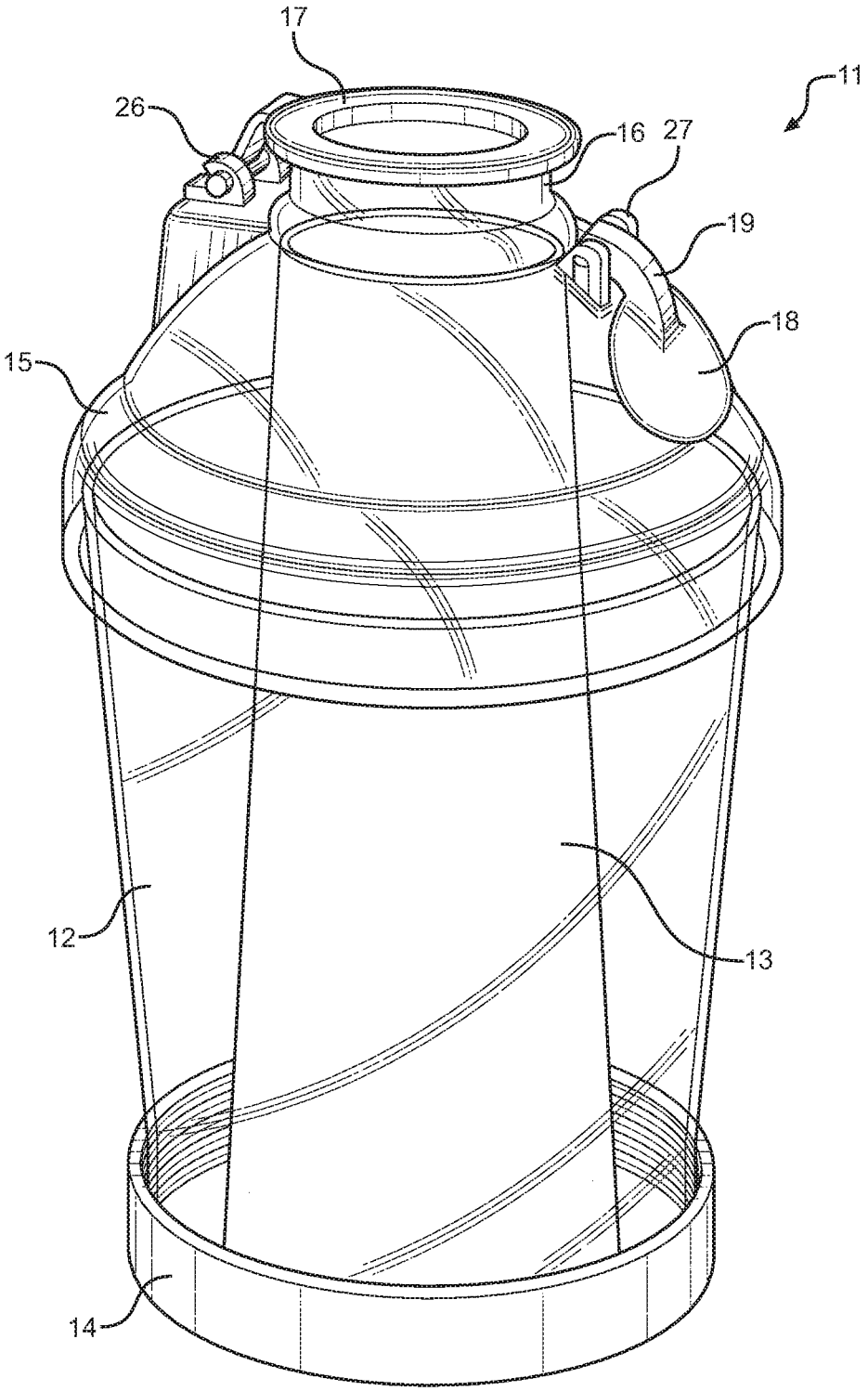
FIG. 2 shows a semi-transparent view of an embodiment of the seed container and shell receptacle fully assembled.
Figure 3:
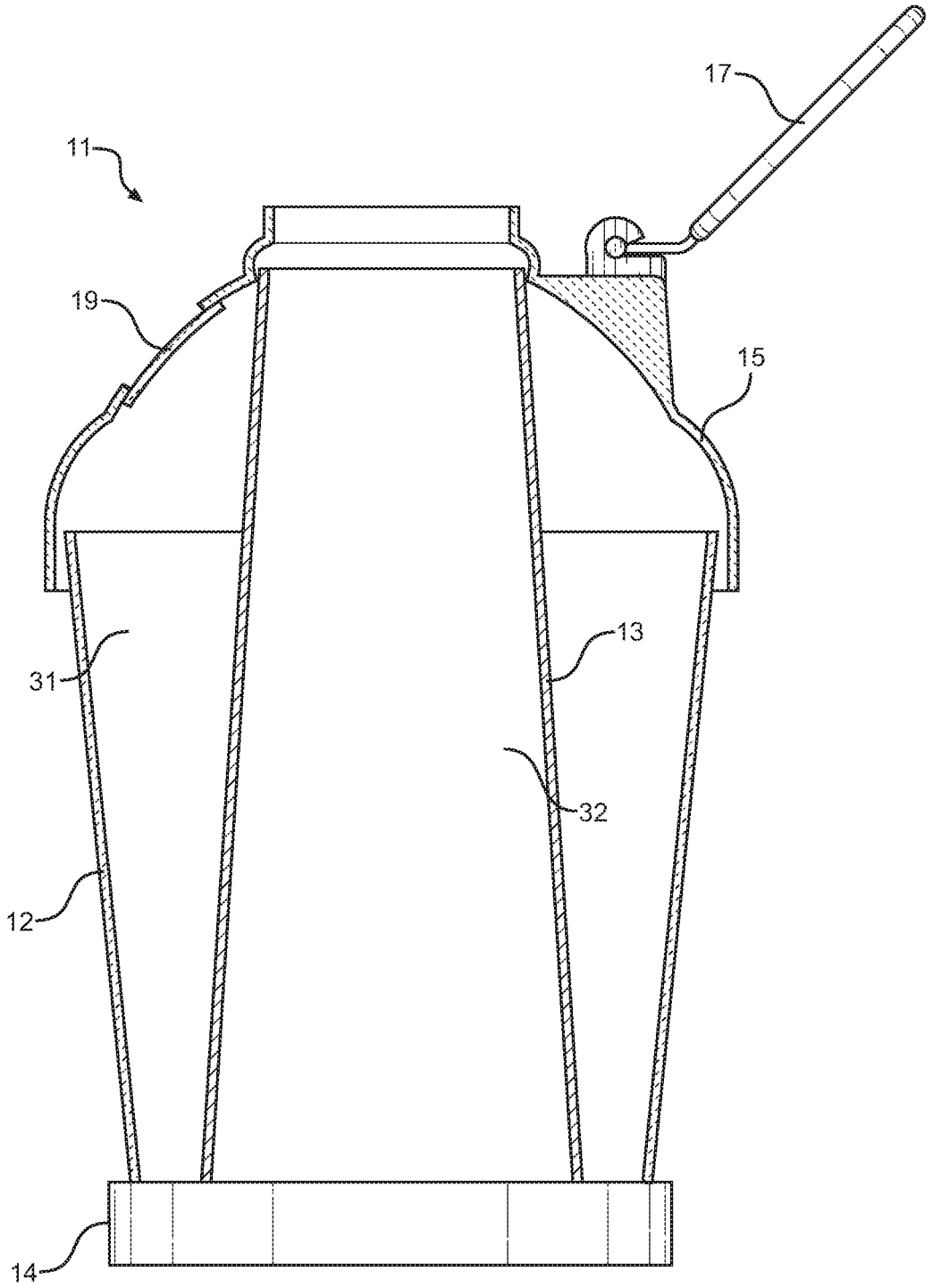
FIG. 3 shows a cross section view of an embodiment of the seed container and shell receptacle.

Referring now to FIGS. 2 and 3, there is shown a perspective view and cross section view of an embodiment of the seed container and shell receptacle fully assembled, respectively. In the illustrated embodiment, the seed container and shell receptacle 11 comprises the inner container 13 nested within the outer container 12 such that the open bottom end 23 rests flush against the removably securable base 14, creating the interior inner volume 32 and the interior outer volume 31. In one embodiment, the inner sidewall 24 forms an acute angle with the base 14. In an alternate embodiment, the inner sidewall 24 rests perpendicular to the base 14. The lid 15 is removably secured to the outer container 12 and features the first aperture 18 and the second aperture 16 as well as a first door 19 and a second door 17. The first door 19 and the second door 17 are adapted to securely seal the first aperture 18 and the second aperture 16, respectively. In the illustrated embodiment, the first door 19 and the second door 17 are attached to the lid 15 by means of a first hinge 27 and a second hinge 26. In some embodiments, the first door 19 comprises a flexible ring member configured to removably secure over a protruding lip of the second aperture 16. The ring member is hingedly affixed to a cap configured to removably secure over the second aperture 16. In another embodiment, the cap is configured to removably secure within the second aperture 16. In other embodiments, the first door 19 and the second door 17 are configured to be removably securable to the first aperture 18 and the second aperture 16 respectively via a compression fit similar to a plug. In another embodiment, the first door 19 and the second door 17 are planar members slidably disposed within the lid 15 such that when closed, the first door 19 and the second door 17 sit flush with the surrounding lid 15. In yet another embodiment, the first door 19 and the second door 17 are planar members slidably disposed within a track disposed on an external surface of the lid 15. Additionally, in other embodiments, first and second door 19, 17 are mismatched, such that the configurations can be any combination of the listed examples.

Figure 4:
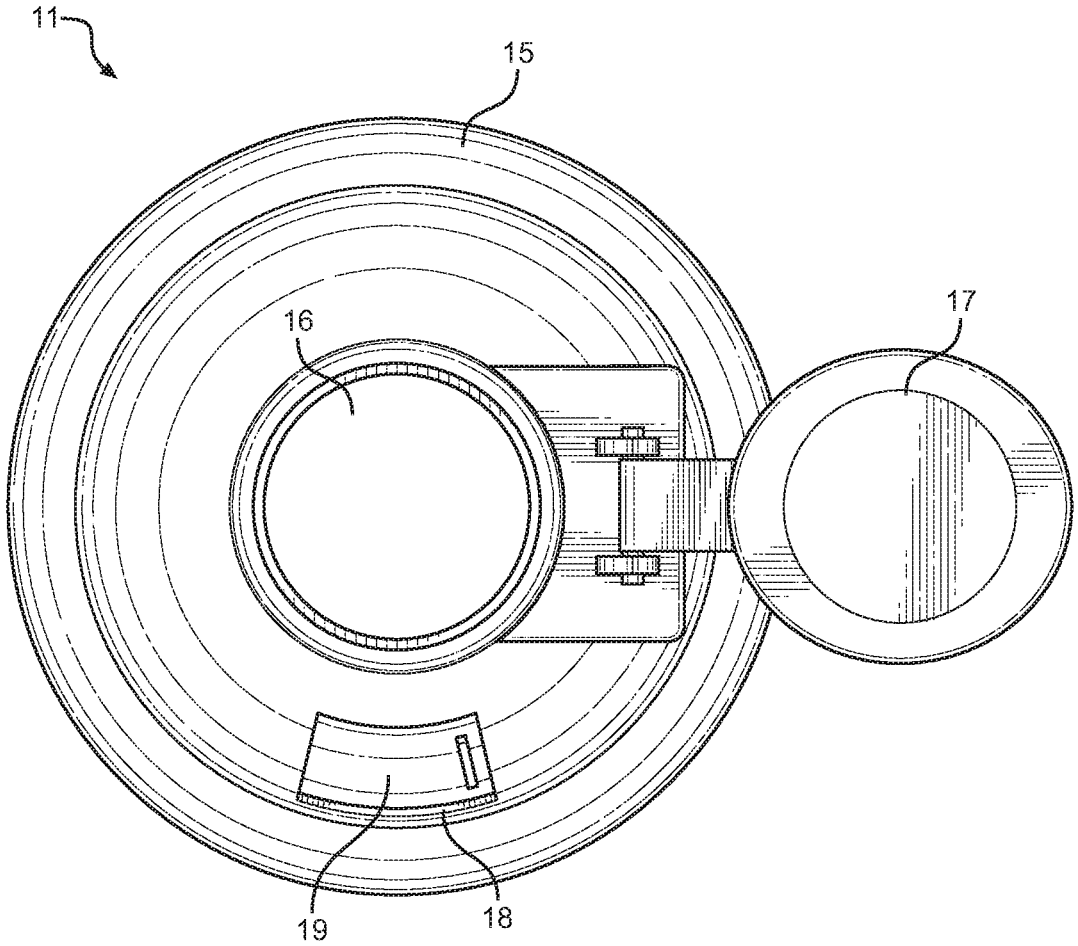
FIG. 4 shows an overhead view of an embodiment of the seed container and shell receptacle.

Referring now to FIG. 4, there is shown an overhead view of an embodiment of the seed container and shell receptacle. In the illustrated embodiment, the first aperture 18 is sealed by first door 19 where the first door 19 comprises a planar member slidably disposed within the lid 15 such that when sealed the first door 19 sits flush with the surrounding lid 15. Furthermore, the illustrated embodiment demonstrates that first door 19 and second door 17 need not be similar, as second door 17 is a cap hingedly attached to the lid 15 adapted to seal second aperture 16.

Figure 5:
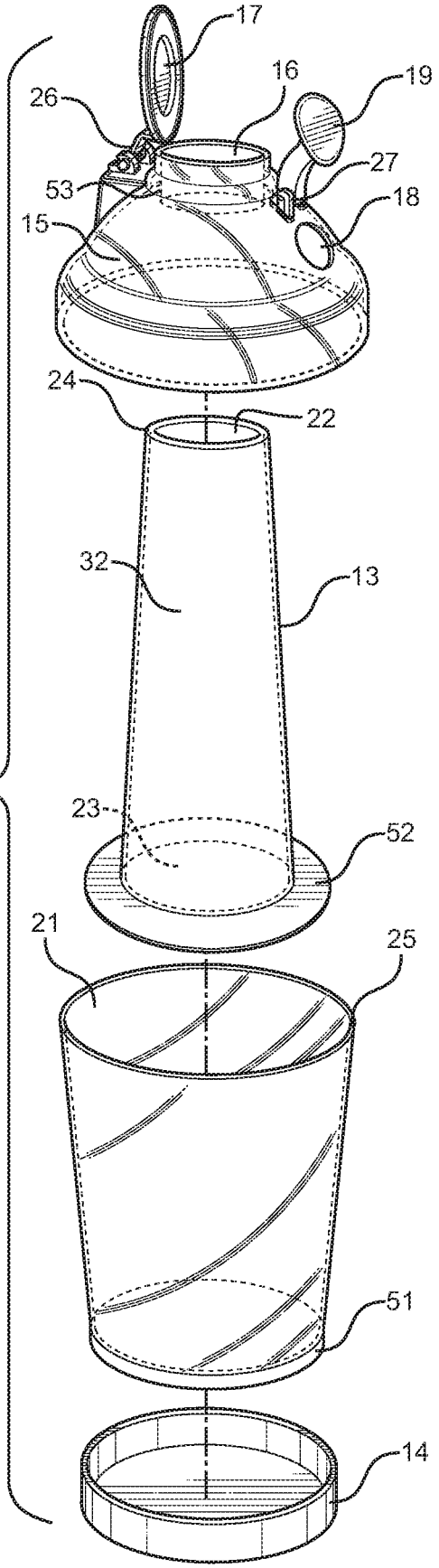
FIG. 5 shows an exploded view of an embodiment of the seed container and shell receptacle.

Referring now to FIG. 5, there is shown an exploded view of an embodiment of the seed container and shell receptacle. In the illustrated embodiment, the outer container 12 further comprises a lip 51 extending perpendicularly inwards towards the center of the outer container 12 disposed adjacent to the base 14. Inner container 13 further comprises a flange 52 extending perpendicularly outwards towards the outer sidewall 25. The flange 52 is configured to rest on the lip 51 to prevent the inner container 13 from falling through the outer container 12 when the base 14 is removed. In the illustrated embodiment, the lid 15 further comprises a channel 53 extending perpendicularly downwards from the second aperture 16 such that the channel 53 rests inside the open top end 22 of inner container 13. The channel 53 assures that any shells or unwanted items are guided directly into the interior inner volume 32 of the inner container 13.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A seed container and shell receptacle, comprising:

an outer container comprising an outer sidewall, a base, and an open upper end, defining an interior outer volume, wherein the base is removably securable to the outer sidewall;

an inner container comprising an inner sidewall, an open bottom end, and an open top end, wherein the inner container is adapted to nest within the outer container such that the base of the outer container acts as an inner container base and defines an interior inner volume;

a lid having a first aperture disposed to give access to the interior outer volume and a second aperture disposed to give access to the interior inner volume, wherein the first aperture and the second aperture are adapted to be closed by a first door and a second door, respectively;

wherein the lid is removably securable to the open upper end of the outer container;

a lip extending perpendicularly inward from the outer sidewall at the base of the outer container; and wherein the lip is configured to support the open bottom end of the inner container thereon when the base is removed from the outer container, such that the inner container is retained within the outer container thereby.

2. The seed container and shell receptacle of claim 1, wherein a flange extends perpendicularly outward from the inner sidewall at the open bottom end of the inner container and a lower surface of the flange is adapted to rest flush on the lip.

3. The seed container and shell receptacle of claim 1, wherein the base is internally threaded to engage external threads on the outer container.

4. The seed container and shell receptacle of claim 1, wherein the base is adapted to affix with the outer container via a compression fit.

5. The seed container and shell receptacle of claim 1, wherein at least one of the first door and the second door is a cap hingedly attached to the lid.

6. The seed container and shell receptacle of claim 1, wherein at least one of the first door and the second door is a cap adapted to affix with the first aperture and second aperture via a compression fit respectively.

7. The seed container and shell receptacle of claim 1, wherein at least one of the first door and the second door is a planar member slidably disposed within the lid and adapted to sit flush with the surrounding lid.

8. The seed container and shell receptacle of claim 1, wherein the inner sidewall of the inner container tapers outwardly towards the open bottom end such that the diameter of the open top end is less than the diameter of the open bottom end.

9. The seed container and shell receptacle of claim 1, wherein the outer sidewall of the outer container tapers outwardly towards the open upper end such that the diameter of the open upper end is greater than the diameter of the base.

10. The seed container and shell receptacle of claim 1, wherein the lid comprises a dome shape.

* * * * *